US010384910B2

(12) United States Patent
Simcik et al.

(10) Patent No.: US 10,384,910 B2
(45) Date of Patent: Aug. 20, 2019

(54) SYSTEM AND METHOD OF INITIATING ELEVATOR SERVICE BY GRAPHICAL OBJECTS

(71) Applicant: Otis Elevator Company, Farmington, CT (US)

(72) Inventors: Paul A. Simcik, Southington, CT (US); Lucien Wedzikowski, Farmington, CT (US); Eric C. Peterson, East Longmeadow, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 600 days.

(21) Appl. No.: 15/141,961

(22) Filed: Apr. 29, 2016

(65) Prior Publication Data

US 2016/0347578 A1 Dec. 1, 2016

Related U.S. Application Data

(60) Provisional application No. 62/167,751, filed on May 28, 2015.

(51) Int. Cl.
*B66B 1/34* (2006.01)
*B66B 1/46* (2006.01)

(52) U.S. Cl.
CPC ..... *B66B 1/468* (2013.01); *B66B 1/463* (2013.01); *B66B 2201/4653* (2013.01)

(58) Field of Classification Search
CPC .. B66B 1/468; B66B 1/463; B66B 2201/4653
USPC ..... 187/247, 380–388, 391, 393, 396
See application file for complete search history.

(56) References Cited

U.S. PATENT DOCUMENTS 5,679,933 A * 10/1997 Weber ..... B66B 1/462 187/389
5,736,692 A * 4/1998 Lumme ..... B66B 1/468 187/247
6,202,799 B1 * 3/2001 Drop ..... B66B 1/468 187/384
6,382,363 B1 * 5/2002 Friedli ..... B66B 1/468 187/384

(Continued)

FOREIGN PATENT DOCUMENTS

CN 103359561 A 10/2013
CN 103538980 A 1/2014

(Continued)

OTHER PUBLICATIONS

KONE Corporation, KONE RemoteCall™ Brochure, 2013.

(Continued)

*Primary Examiner* — Anthony J Salata
(74) *Attorney, Agent, or Firm* — Cantor Colburn LLP

(57) ABSTRACT

The present disclosure relates generally to a system and method of initiating elevator service by entering an elevator call with a call input device operating a program including a preferred landing graphical object comprising at least one floor designation graphical objects displayed on a graphic user interface, in communication with an elevator system. The method includes the steps: selecting a current floor graphical object from the preferred landing graphical object, and selecting a destination floor graphical object from the preferred landing graphical object.

14 Claims, 2 Drawing Sheets

(56) References Cited

U.S. PATENT DOCUMENTS

| | | | | |
|---|---|---|---|---|
| 6,502,668 | B1 * | 1/2003 | Chida | H01H 13/70 187/391 |
| 7,093,693 | B1 * | 8/2006 | Gazdzinski | B66B 1/468 187/384 |
| 7,377,364 | B2 | 5/2008 | Tyni et al. | |
| 8,136,636 | B2 | 3/2012 | Bahjat et al. | |
| 8,151,942 | B2 * | 4/2012 | Rusanen | B66B 1/468 187/247 |
| 8,485,317 | B2 | 7/2013 | Gerstenkorn et al. | |
| 8,880,200 | B2 | 11/2014 | Nowel | |
| 9,469,502 | B2 * | 10/2016 | Parkkinen | B66B 3/006 |
| 9,561,931 | B2 * | 2/2017 | Kauppinen | B66B 1/468 |
| 9,994,422 | B2 * | 6/2018 | Hiltunen | B66B 1/461 |
| 2012/0048655 | A1 | 3/2012 | Hsu | |
| 2014/0146007 | A1 | 5/2014 | Lee et al. | |
| 2017/0174473 | A1 * | 6/2017 | Simcik | B66B 1/468 |
| 2017/0305716 | A1 * | 10/2017 | Peterson | B66B 1/468 |
| 2017/0341903 | A1 * | 11/2017 | Adkins | B66B 1/463 |
| 2017/0355556 | A1 * | 12/2017 | Simcik | B66B 1/468 |

FOREIGN PATENT DOCUMENTS

| | | | |
|---|---|---|---|
| EP | 2730530 | A1 | 5/2014 |
| EP | 3098191 | A1 | 11/2016 |
| WO | 2006011876 | A1 | 2/2006 |
| WO | 2011102654 | A2 | 8/2011 |
| WO | 2013191705 | A1 | 12/2013 |
| WO | 2014049201 | A1 | 4/2014 |
| WO | 2014116182 | A1 | 7/2014 |
| WO | 2014178790 | A1 | 11/2014 |
| WO | 2014186946 | A1 | 11/2014 |
| WO | 2015015049 | A1 | 2/2015 |

OTHER PUBLICATIONS

Schindler Transit Management Group myPORT Brochure 2014.
Chinese First Office Action for application CN 201610318228.4, dated Oct. 9, 2017, 9 pages.
European Search Report for application EP 16167812,3, dated Sep. 26, 2016, 10 pages.

* cited by examiner

SYSTEM AND METHOD OF INITIATING ELEVATOR SERVICE BY GRAPHICAL OBJECTS

CROSS REFERENCE TO RELATED APPLICATIONS

The present application is related to, and claims the priority benefit of, U.S. Provisional Patent Application Ser. No. 62/167,751 filed May 28, 2015, the contents of which are hereby incorporated in their entirety into the present disclosure.

TECHNICAL FIELD OF THE DISCLOSED EMBODIMENTS

The present disclosure is generally related to elevator systems and, more specifically, a system and method for initiating elevator service by entering an elevator call.

BACKGROUND OF THE DISCLOSED EMBODIMENTS

Entering an elevator call from a location away from the elevator provides convenience to a user to allow an elevator car to be potentially ready once the user arrives at the elevator doors. Generally, initiating an elevator call remotely requires an inconvenient and cumbersome process of a user using a mobile device to scroll and/or input an appropriate source and destination landing; then, possibly confirming that the selections made are correct. There is therefore a need for a more intuitive, convenient, and faster method of initiating an elevator call.

SUMMARY OF THE DISCLOSED EMBODIMENTS

In one aspect, a system for initiating elevator service is provided. The system includes an elevator system in communication with a call input device. In one embodiment, the call input device includes a mobile device. The call input device includes a processor, memory, and a graphical user interface. In one embodiment, the graphical user interface includes a touch screen display. A program stored in memory operates to display a plurality of graphical objects on the graphical user interface. The program is further configured to initiate a call to the elevator system by allowing a user to operate a preferred landing graphical object. In one embodiment, the floor graphical object is moveable.

In one aspect, a method for initiating an elevator call is provided. The method includes the step of selecting a current floor graphical object from the preferred landing graphical object. In an embodiment, selecting the current floor graphical object includes touching the current floor graphical object at least once with an object. In one embodiment, the step further includes creating a preferred landing graphical object based on at least one of the floor designation graphical objects, and displaying the preferred landing graphical object. In an embodiment, the program may suggest a floor designation graphical object to be placed in the preferred landing graphical object for selection based at least in part on the user's travel history and/or anticipated travel.

After selection of the current floor graphical object from the preferred landing graphical object, the method proceeds to the step of selecting a destination floor graphical object from the preferred landing graphical object. In one embodiment, the selected destination floor graphical object designates the desired destination landing of the user. In one embodiment, selecting the destination floor graphical object includes moving the current floor graphical object such that the current floor graphical object overlays the desired destination floor graphical object.

Other embodiments are also disclosed.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
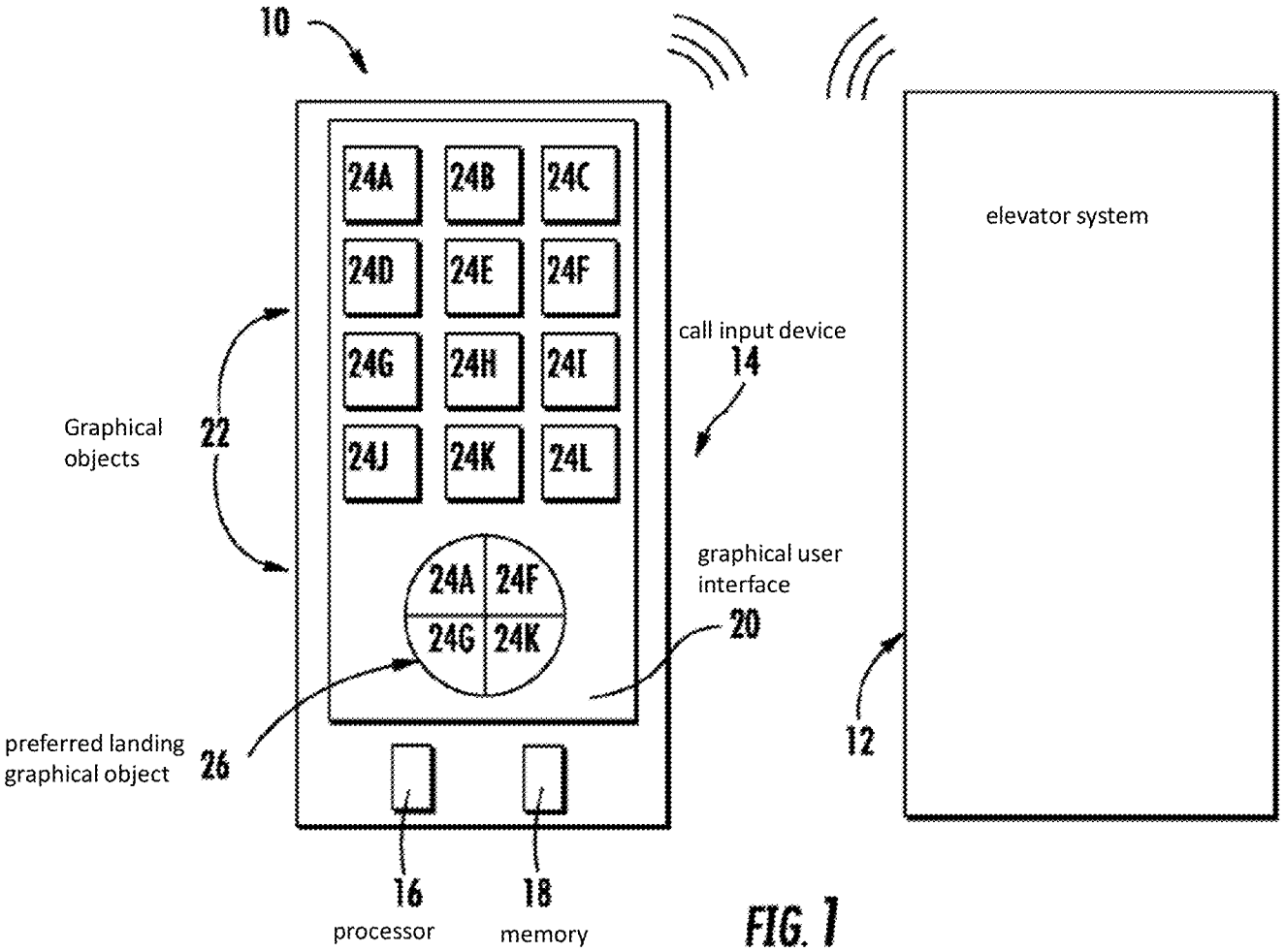
FIG. 1 is a schematic diagram of a system for initiating elevator service.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 schematically illustrates a system for initiating elevator service, generally indicated at 10. The system 10 includes an elevator system 12 in communication with a call input device 14. In one embodiment, the call input device 14 includes a mobile device. It will be appreciated that the call input device 14 may be any mobile device specifically suited for this purpose, for example, a mobile telephone, tablet device, or any device capable of being carried by a person outside of a home to name a few non-limiting examples. It will be appreciated that a communication module (not shown) is located within each of the elevator system 12 and the call input device 14 to enable wireless communication between the elevator system 12 and the call input device 14. The call input device 14 includes a processor 16, memory 18, and a graphical user interface 20. In one embodiment, the graphical user interface 20 includes a touch screen display. A program stored in memory 18 operates to display a plurality of graphical objects 22 on the graphical user interface 20. It will be appreciated that the plurality of graphical objects 22 need not fit on one page of the screen, and may occupy multiple pages on the display. It will also be appreciated that the plurality of graphical objects 22 may be on a current page and accessible via a scrolling action on the display. The program is further configured to initiate a call to the elevator system 12, as described in the method of FIG. 2, by allowing a user to operate a preferred landing graphical object 26 including at least one floor designation graphical object 24. In one embodiment, the floor graphical object 24 is moveable.

The system 10 additionally includes up-down call buttons (not shown) as are normally used for the input of traditional landing calls, and car call buttons inside the elevator car. Those passengers who have a call input device 14 use it to summon the elevator car to where the user is located and place a call to another landing. Other passengers give a landing call in the traditional manner by pressing the up-down call buttons and a car call via the car operating panel.

When a user, carrying a call input device 14, initiates elevator service, the call input device 14 and the elevator system 12 establish a connection permitting data transfer. When the user initiates the call, by the method presented in FIG. 2, a communication cycle is started between the call input device 14 and the elevator system 12.

Figure 2:
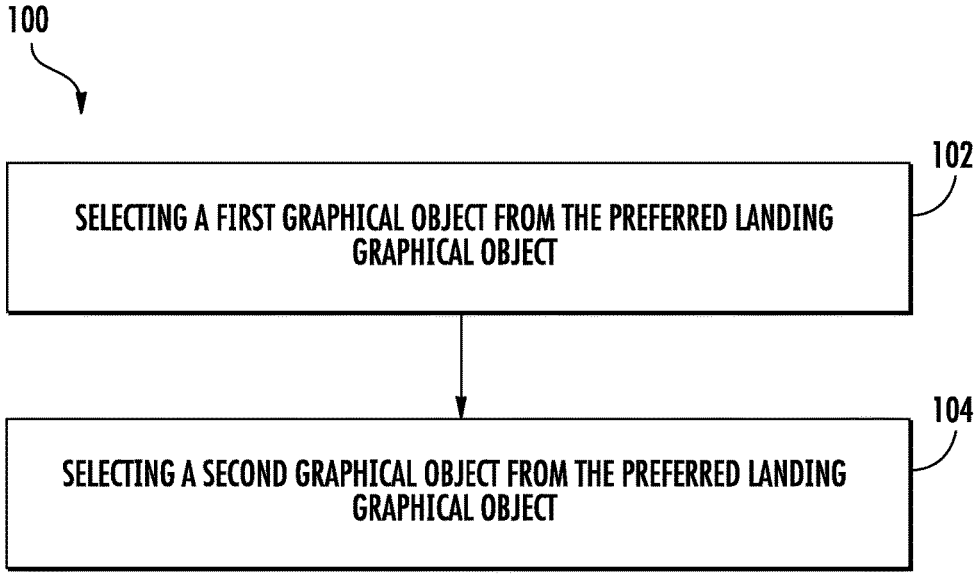
FIG. 2 is a schematic flow diagram of a method for initiating elevator service by initiating an elevator call.

FIG. 2 illustrates a method 100 for initiating an elevator call using the system 10. As discussed above, the system 10 includes a call input device 14 that displays a plurality of graphical objects 22 where a graphical object 22 corresponds to a floor in the building serviced by the elevator system 12. The method includes the step 102 of selecting a current floor graphical object 24 from the preferred landing graphical object 26. In an embodiment, selecting the current floor graphical object 24 includes touching the current floor graphical object 24 at least once with an object (not shown). It will be appreciated that the object may include any object that may be detectable by the touchscreen display 20, such as a finger or stylus to name two non-limiting examples. For example, the user operates the program on the call input device 14 to initiate an elevator call; the user selects the source floor in which the user is currently located. If one of the user's preferred landings is located on the fourth floor of a building, the user selects the floor graphical object 24 displayed within the preferred landing graphical object 26, on the graphical user interface 20 designating the fourth floor. It will be appreciated that the selected current floor graphical object 24 may designate a front or rear opening landing.

In one embodiment, step 102 further includes creating a preferred landing graphical object 26 based on at least one of the floor designation graphical objects 24, and displaying the preferred landing graphical object 26. For example, the user may select any number of floor designation graphical objects 24 to be placed within the preferred landing graphical object 26 by any suitable methods, such as selecting from a menu, dragging the floor designation graphical objects 24 to a designated location, etc. It will also be appreciated that the user may change any of the floor designation graphical objects 24 within the preferred landing graphical object 26 by any suitable methods, such as pressing the floor designation graphical objects 24 for a specified period of time, and confirming deletion, dragging the floor designation graphical objects 24 away from a designated location, etc. In an embodiment, the program may suggest a floor designation graphical object 24 to be placed in the preferred landing graphical object 26 for selection based at least in part on the user's travel history and/or anticipated travel. For example, with reference to FIG. 1, if the user typically initiates an elevator call using the floor graphical objects 24A 24F, 24G, and 24K, the program may suggest placing the floor graphical object 24A 24F, 24G, and 24K within the preferred landing graphical object 26.

After selection of the current floor graphical object 24 from the preferred landing graphical object 26, the method proceeds to step 104 of selecting a destination floor graphical object 24 from the preferred landing graphical object 26. In one embodiment, the selected destination floor graphical object 24 designates the desired destination landing of the user. In one embodiment, selecting the destination floor graphical object 24 includes moving the current floor graphical object 24 such that the current floor graphical object 24 overlays the desired destination floor graphical object 24. For example, if the user desires to move from the first floor to the sixth floor, the user moves the current floor graphical object 24A designated for the first floor until the current floor graphical object 24A overlays the destination floor graphical object 24F designated for the sixth floor. It will be appreciated that the selected destination floor graphical object 24 may designate a front or rear opening landing. In another embodiment, selecting the destination floor graphical object 24 includes touching the destination floor graphical object 24 at least once with an object.

It will be appreciated that a user may quickly, and conveniently initiate elevator service from a call input device 14 by selecting a current floor graphical object 24 and a destination floor graphical object 24 from a preferred landing graphical object 26 displayed on a graphical user interface 20.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A method for initiating elevator service by entering an elevator call on a call input device operating a program including a plurality of floor designation graphical objects displayed on a graphical user interface, the method comprising:

selecting a current floor graphical object from a preferred landing graphical object; and selecting a destination floor graphical object from the preferred landing graphical object;

wherein at least one of the plurality of floor designation graphical objects is moveable.

2. The method of claim 1, wherein selecting the current floor graphical object further includes: creating a preferred landing graphical object based on at least one of the floor designation graphical objects; and displaying the preferred landing graphical object.

3. The method of claim 2, wherein the floor designation graphical objects within the preferred landing graphical object comprise a suggested floor designation graphical objects suggested by the call input device.

4. A method for initiating elevator service by entering an elevator call on a call input device operating a program including a plurality of floor designation graphical objects displayed on a graphical user interface, the method comprising:

selecting a current floor graphical object from a preferred landing graphical object, wherein selecting the current floor graphical object includes creating a preferred landing graphical object based on at least one of the floor designation graphical objects and displaying the preferred landing graphical object; and selecting a destination floor graphical object from the preferred landing graphical object;

wherein each of the at least one floor designation graphical objects are moveable.

5. The method of claim 1, wherein the call input device comprises a mobile device.

6. The method of claim 1, wherein the graphical user interface comprises a touch screen display.

7. The method of claim 1, wherein selecting the current floor graphical object comprises touching the current floor graphical object at least once with an object.

8. The method of claim 1, wherein selecting the destination floor graphical object comprises:

touching the destination floor graphical object at least once with an object; and/or moving the current floor graphical object to overlay the destination floor graphical object.

9. A system for making elevator calls comprising:

an elevator system;

a call input device, in communication with the elevator system;

wherein the call input device includes a graphical user interface and software configured to:

display a preferred landing graphical object on the graphical user interface;

the preferred landing graphical object comprising at least one floor designation graphical objects; and initiate an elevator call by allowing a user to select a current floor graphical object and/or a destination floor graphical object from the preferred landing graphical object;

wherein at least one of the current floor graphical object and the destination floor graphical object are moveable.

10. The system of claim 9, wherein the floor designation graphical objects within the preferred landing graphical object comprise a suggested floor designation graphical objects suggested by the call input device.

11. The system on claim 9, wherein the call input device comprises a mobile device.

12. The system of claim 9, wherein the graphical user interface comprises a touch screen display.

13. The system of claim 9, wherein the software is further configured to detect the selection of the current floor graphical object by allowing the user to touch the current floor graphical object at least once with an object.

14. The system of claim 9, wherein the software is configured to detect the selection the destination floor graphical object by allowing the user to:

touch the destination floor graphical object at least once with an object; and/or move the current floor graphical object to overlay the destination floor graphical object.

* * * * *